US006597796B2

(12) United States Patent
Chang

(10) Patent No.: US 6,597,796 B2
(45) Date of Patent: Jul. 22, 2003

(54) MICROPHONE WITH A VARIABLE RESISTANCE SWITCH

(76) Inventor: Chao-Chih Chang, No. 43, Tung-Nan St., Tung Dist., Taichung City (TW)

( * ) Notice: Subject to any disclaimer, the term of this patent is extended or adjusted under 35 U.S.C. 154(b) by 53 days.

(21) Appl. No.: 10/037,715

(22) Filed: Nov. 9, 2001

(65) Prior Publication Data

US 2003/0091208 A1 May 15, 2003

(51) Int. Cl.[7] ..... H04R 25/00

(52) U.S. Cl. ..... 381/361; 381/355; 338/178; 338/179

(58) Field of Search ..... 381/355, 361, 381/366, 365, 368; 338/176, 178–179

(56) References Cited

U.S. PATENT DOCUMENTS 3,633,146 A * 1/1972 Sasaki et al. ..... 338/178
3,643,046 A * 2/1972 Zdanys et al. ..... 200/430
4,085,399 A * 4/1978 Wall ..... 338/200
4,357,592 A * 11/1982 Okuya ..... 338/198
4,771,263 A * 9/1988 Crook et al. ..... 338/176
5,706,359 A * 1/1998 Chang ..... 381/361

* cited by examiner

*Primary Examiner*—Rexford Barnie
*Assistant Examiner*—P. Dabney
(74) *Attorney, Agent, or Firm*—Brinks Hofer Gilson & Lione

(57) ABSTRACT

A microphone includes a housing, a plurality of terminals, and a variable resistance switch. The switch includes a resistance member having opposite first and second ends connected to respective ones of the terminals. A conductive member has one end connected to a respective one of the terminals. A slide member includes a wiper that is simultaneously and constantly in sliding contact with the resistance member and the conductive member so as to complete a circuit through the terminals, the conductive member, and the resistance member. The wiper is slidable over the conductive member and the resistance member so as to linearly vary the resistance in the circuit.

2 Claims, 12 Drawing Sheets

MICROPHONE WITH A VARIABLE RESISTANCE SWITCH

BACKGROUND OF THE INVENTION

1. Field of the invention

This invention relates to a microphone with a variable resistance switch.

2. Description of the related art

FIGS. 1 to 3 illustrate a conventional microphone switch 100 for a microphone which is adapted to be connected to at least a speaker system (not shown) The switch 100 includes a U-shaped mounting frame 1, and a slide member 2 that is disposed movably in the mounting frame 1, that is formed with two parallel grooves 201 at a bottom side, and that is movable between ON and OFF positions. A terminal member 3 is mounted in the mounting frame 1, and has aligned first, second and third pairs of conductive rails 301, 302, 303. A pair of conductive contact members 304 are fittingly and respectively received in the grooves 201, and are engageable with the first and second pairs of the conductive rails 301, 302 when the slide member 2 is at the ON position so as to complete a circuit in the microphone, and with the second and third pairs of the conductive rails 302, 303 when the slide member 2 is at the OFF position so as to short the circuit. The microphone is disadvantageous in that a relatively large noise is generally produced by the speaker system due to an abrupt change in the resistance of the circuit upon switching of the slide member 2 to the ON position.

SUMMARY OF THE INVENTION

Therefore, the object of the present invention is to provide a microphone with a variable resistance switch so as to overcome the aforesaid drawbacks.

According to the present invention, a microphone comprises: a housing; a terminal member disposed in the housing and including a plurality of spaced apart terminals; and a variable resistance switch. The switch includes at least an elongated resistance member disposed in the housing, extending in a longitudinal direction, and having opposite first and second ends connected to respective ones of the terminals. An elongated conductive member is disposed in the housing adjacent and parallel to the resistance member, and has one end connected to a respective one of the terminals. A slide member includes at least a resilient conductive wiper that is disposed in the housing and that is simultaneously and constantly in sliding contact with the resistance member and the conductive member so as to complete a circuit through the terminals, the conductive member, and the resistance member. The slide member is operable to move in the longitudinal direction between an ON position, in which, the wiper is in sliding contact with the second end of the resistance member, and an OFF position, in which, the wiper is in sliding contact with the first end of the resistance member. The wiper is slidable over the conductive member and the resistance member so as to linearly vary the resistance in the circuit when the slide member moves between the ON and OFF positions.

BRIEF DESCRIPTION OF THE DRAWINGS

In drawings which illustrate an embodiment of the invention.

DETAILED DESCRIPTION OF THE PREFERRED EMBODIMENT

Figure 1:
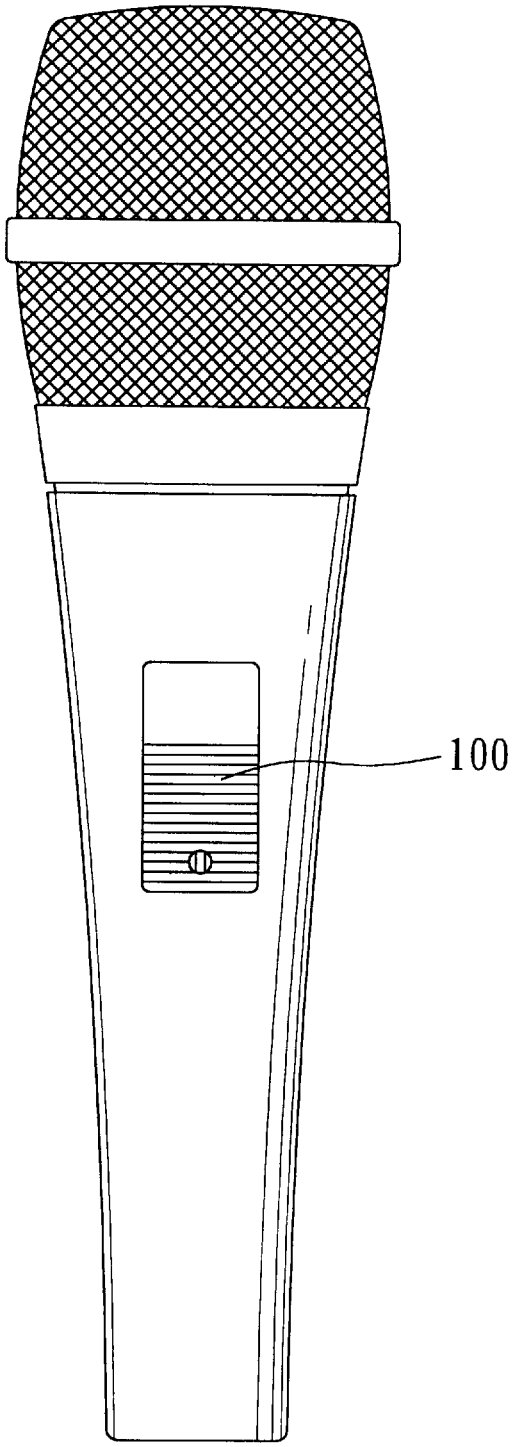
FIG. 1 PRIOR ART
FIG. 1 is a side view of a conventional microphone.
Figure 2:
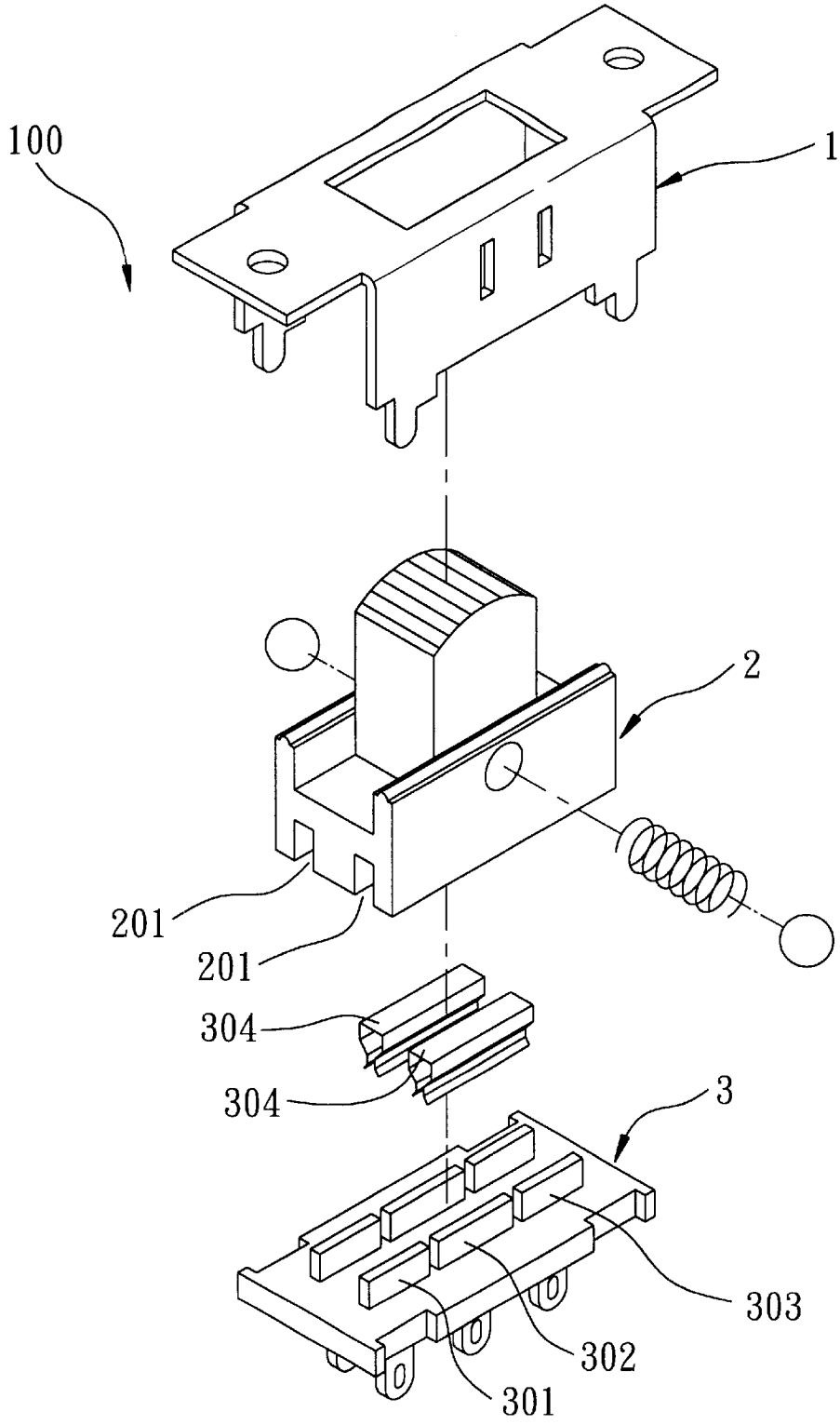
FIG. 2 PRIOR ART
FIG. 2 is an exploded perspective view of a switch of the microphone of FIG. 1.
Figure 3:
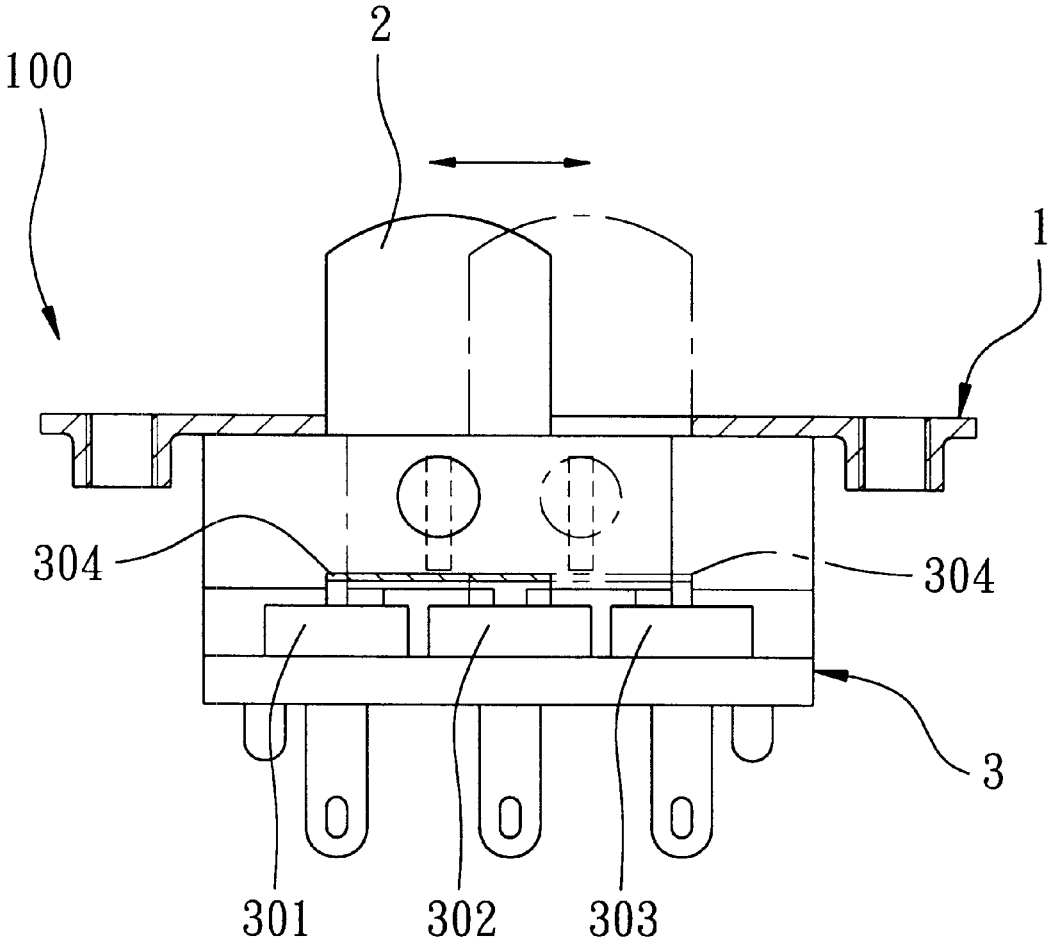
FIG. 3 PRIOR ART
FIG. 3 is a side view to illustrate how the switch of FIG. 2 can be moved between ON and OFF positions.

FIGS. 4 to 8 illustrate a microphone 400 embodying this invention and adapted to be connected to at least a speaker system (not shown).

The microphone 400 includes a housing 401, a terminal member 40 having a plurality of spaced apart terminals 43, and a variable resistance switch 300.

Figure 5:
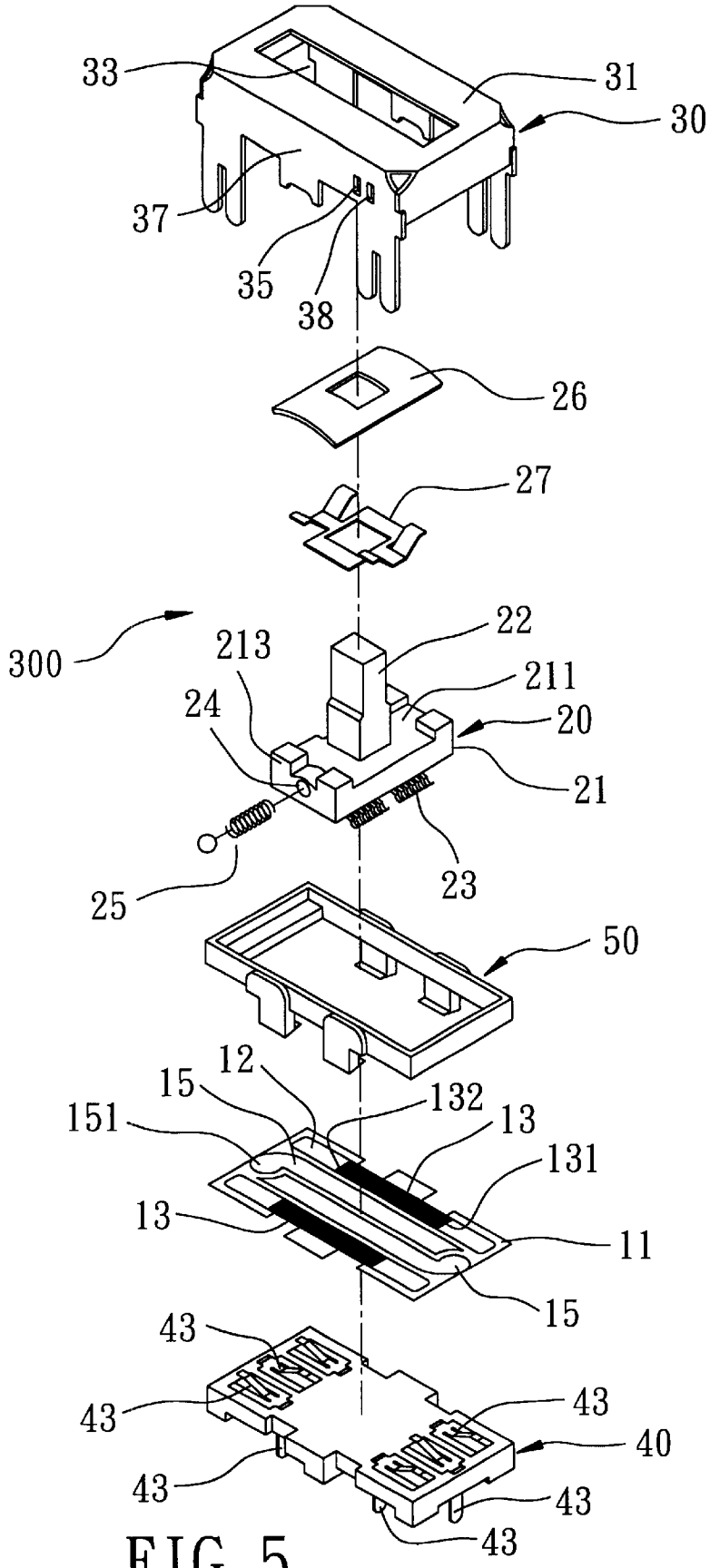
FIG. 5 is an exploded perspective view of a variable resistance switch of the microphone of FIG. 4.
Figure 9:
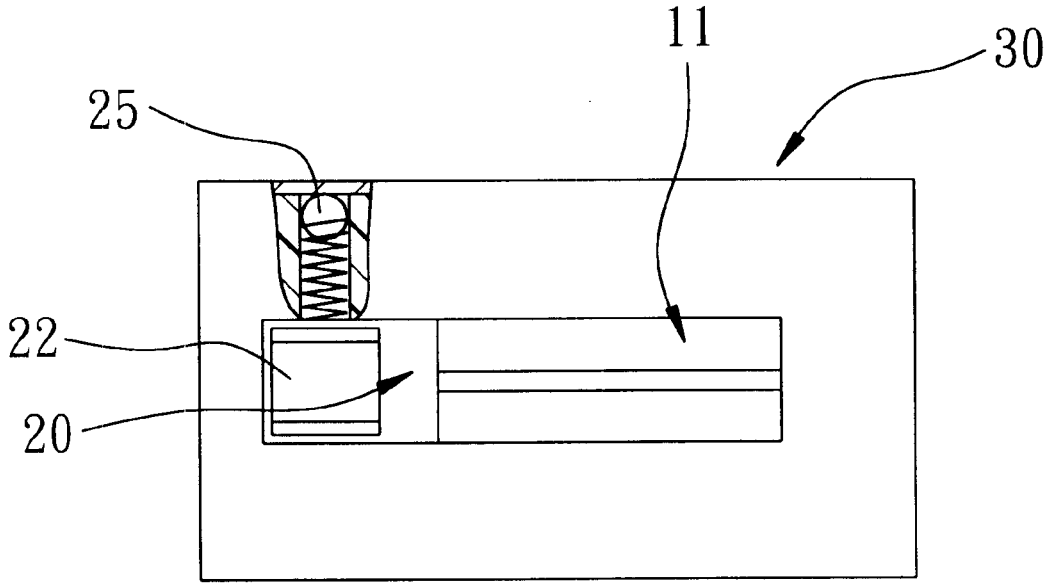
FIGS. 9 to 11 are partly cutaway top views to illustrate how the slide member can be moved between and positioned at the ON and OFF positions and a REST position.
Figure 10:
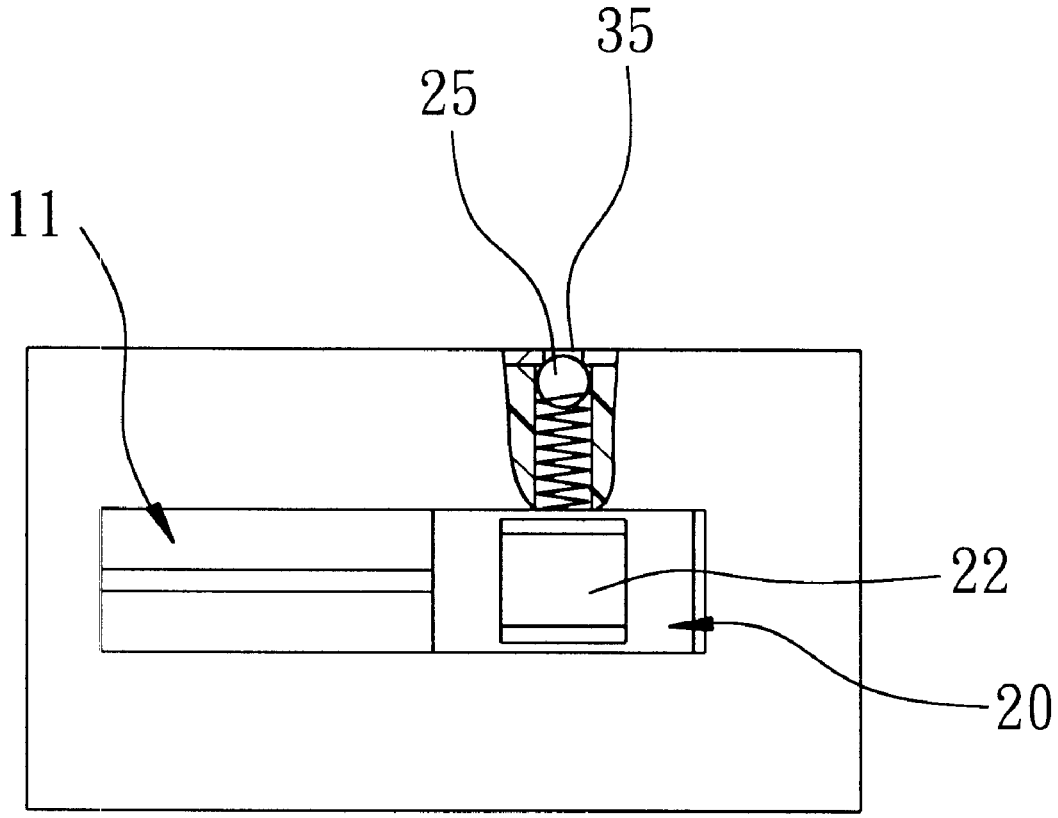

The variable resistance switch 300 includes at least an elongated resistance member 13 (two resistance members 13 are employed in the preferred embodiment of FIG. 5) disposed in the housing 401, extending in a longitudinal direction, and having opposite first and second ends 131, 132 connected to respective ones of the terminals 43. An elongated conductive member 15 is disposed in the housing 401 adjacent and parallel to the resistance member 13, and has one end 151 connected to a respective one of the terminals 43. A slide member 20 includes at least a resilient conductive wiper 23 (two wipers 23 are employed and are respectively associated with the two resistance members 13 in FIG. 5) that is disposed in the housing 401 and that is simultaneously and constantly in sliding contact with the resistance member 13 and the conductive member 15 so as to complete a circuit through the terminals 43, the conductive member 15, and the resistance member 13 in the microphone 400. The slide member 20 is operable to move in the longitudinal direction between an ON position (see FIGS. 7 to 9), in which, the wiper 23 is in sliding contact with the second end 132 of the resistance member 13, and an OFF position (see FIGS. 7 and 10), in which, the wiper 23 is in sliding contact with the first end 131 of the resistance member 13. The wiper 23 is slidable over the conductive member 15 and the resistance member 13 so as to linearly vary the resistance in the circuit when the slide member 20 moves between the ON and OFF positions.

The housing 401 is formed with a switch hole 420. The switch 300 further includes a sheet-type insulator substrate 11 and lower and upper mounting frames 50, 30 which cooperately define a mounting space 60 therebetween. The resistance member 13 and the conductive member 15 are printed on the substrate 11. The substrate 11 is seated on the lower mounting frame 50 within the mounting space 60. The switch 300 further includes a conductive trace 12 that is printed on the substrate 11 and that extends from the first end 131 of the resistance member 13 in the longitudinal direction. A plurality of spaced apart conductive contacts are formed on a bottom side of the substrate 11, and are respectively connected to the first and second ends 131, 132 of the resistance member 13 and the conductive trace 12 so as to connect the first and second ends 131, 132 of the resistance member 13 and the conductive trace 12 to the respective terminals 43.

Figure 11:
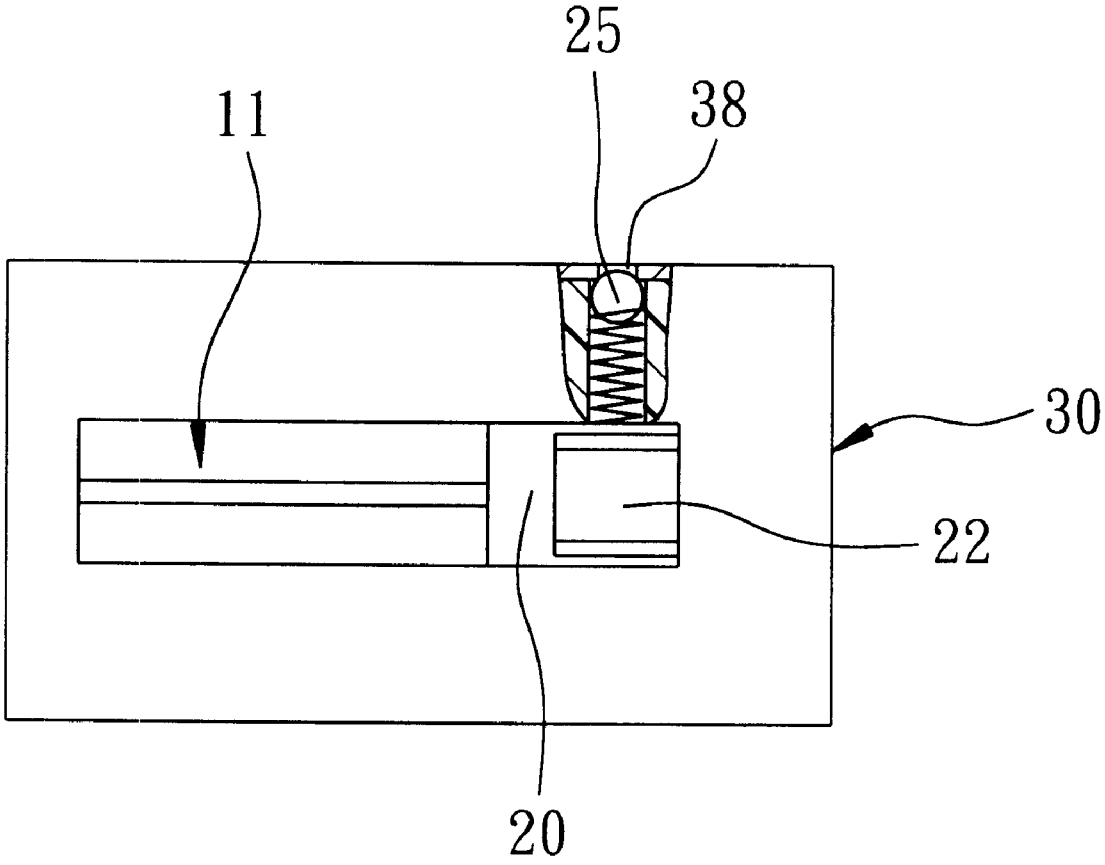
Figure 12:
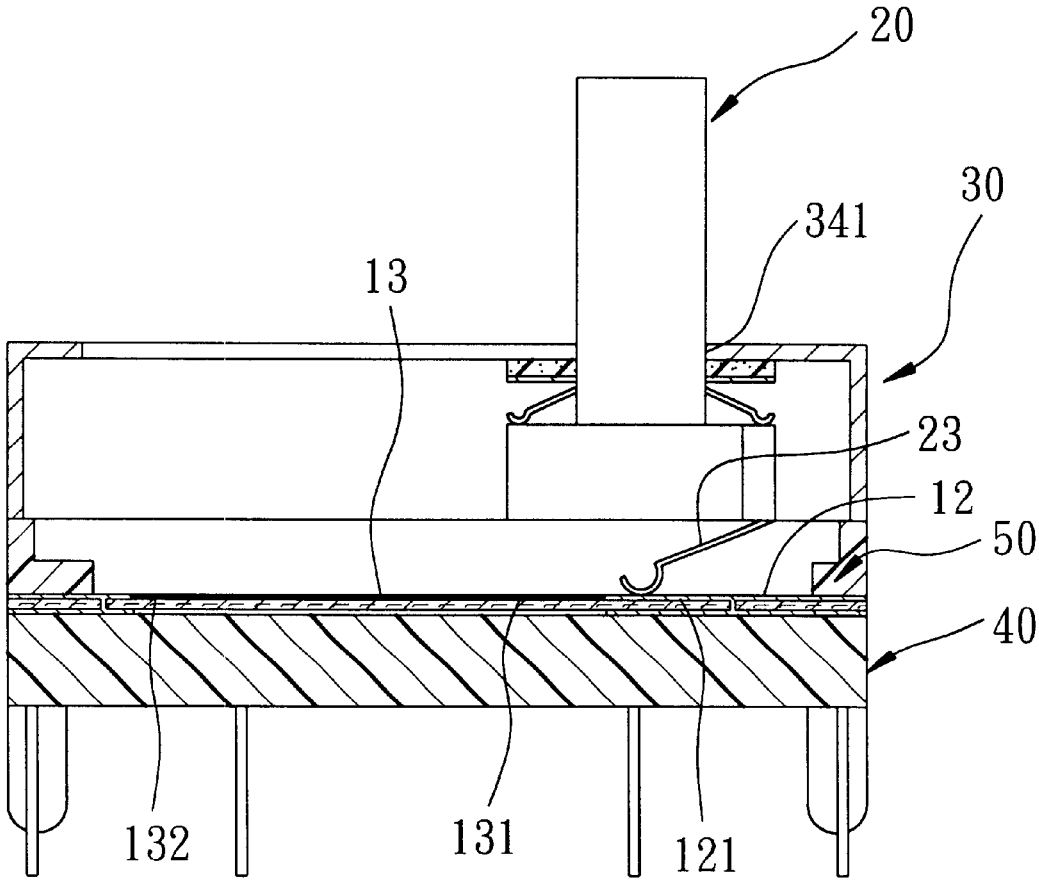
FIG. 12 is a sectional side view to illustrate the slide member of the switch of FIG. 6 at the REST position.

The upper mounting frame 30 has a top wall 31 formed with an inner slot 33 that is vertically aligned with the resistance member 13, and a first side wall 37 formed with a first retaining hole 35 that is aligned with the first end 131 of the resistance member 13 in a transverse direction relative to the longitudinal direction and a second retaining hole 38 that is aligned with the conductive trace 12 in the transverse direction. The slide member 20 further includes a wiper mounting seat 21 that is mounted slidably in the mounting space 60 and that has a second side wall 213 confronting the first side wall 37 and formed with a spring retaining recess 24. The wiper 23 extends downwardly from the wiper mounting seat 21 so as to be slidable over the resistance member 13 and the conductive member 15. The slide member 20 further includes an actuating post 22 that projects outwardly of the mounting space 60 from the wiper mounting seat 21 through the inner slot 33 and the switch hole 420, and a spring-biased ball 25 mounted in the spring retaining recess 24 and releasably engaging the first retaining hole 35 when the wiper 23 is moved to the first end 131 of the resistance member 13. A spring member 27 is sleeved around the actuating post 22 within the mounting space 60, and abuts against a top face 211 of the slide member 21. A washer member 26 is disposed over the spring member 27, is sleeved around the actuating post 22, and abuts against an inner face of the top wall 31 of the upper mounting frame 30 and the spring member 27 so as to permit the spring member 27 to urge the wiper 23 to be resiliently and slidably in contact with the resistance member 13 and the conductive member 15. The slide member 20 is further movable to a REST position (see FIGS. 11 and 12) in which the spring-biased ball 25 releasably engages the second retaining hole 38 and the wiper 23 is in sliding contact with the conductive trace 12 and the conductive member 15 so as to short circuit the circuit.

Figure 4:
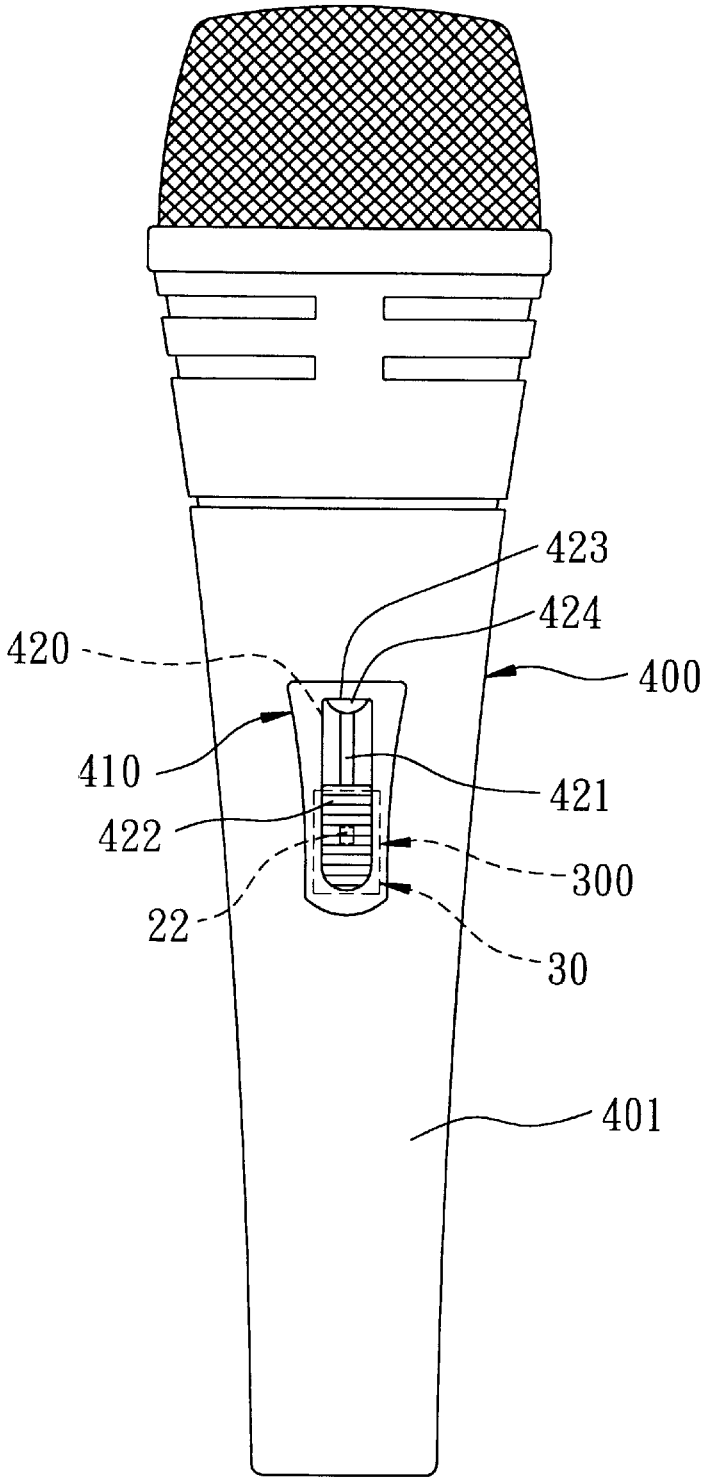
FIG. 4 is a side view of a microphone embodying this invention.
Figure 6:
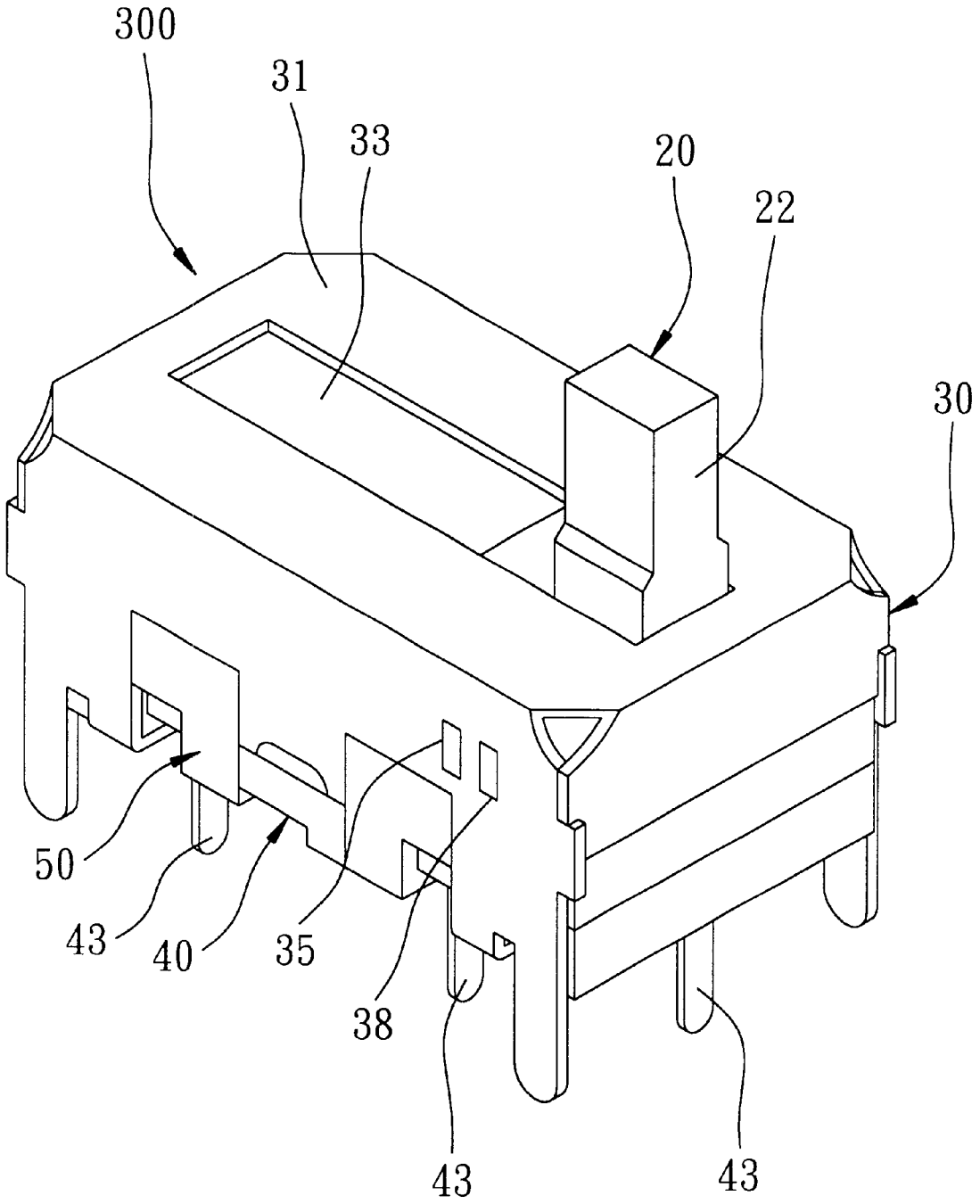
FIG. 6 is a perspective view of the switch of FIG. 5.
Figure 7:
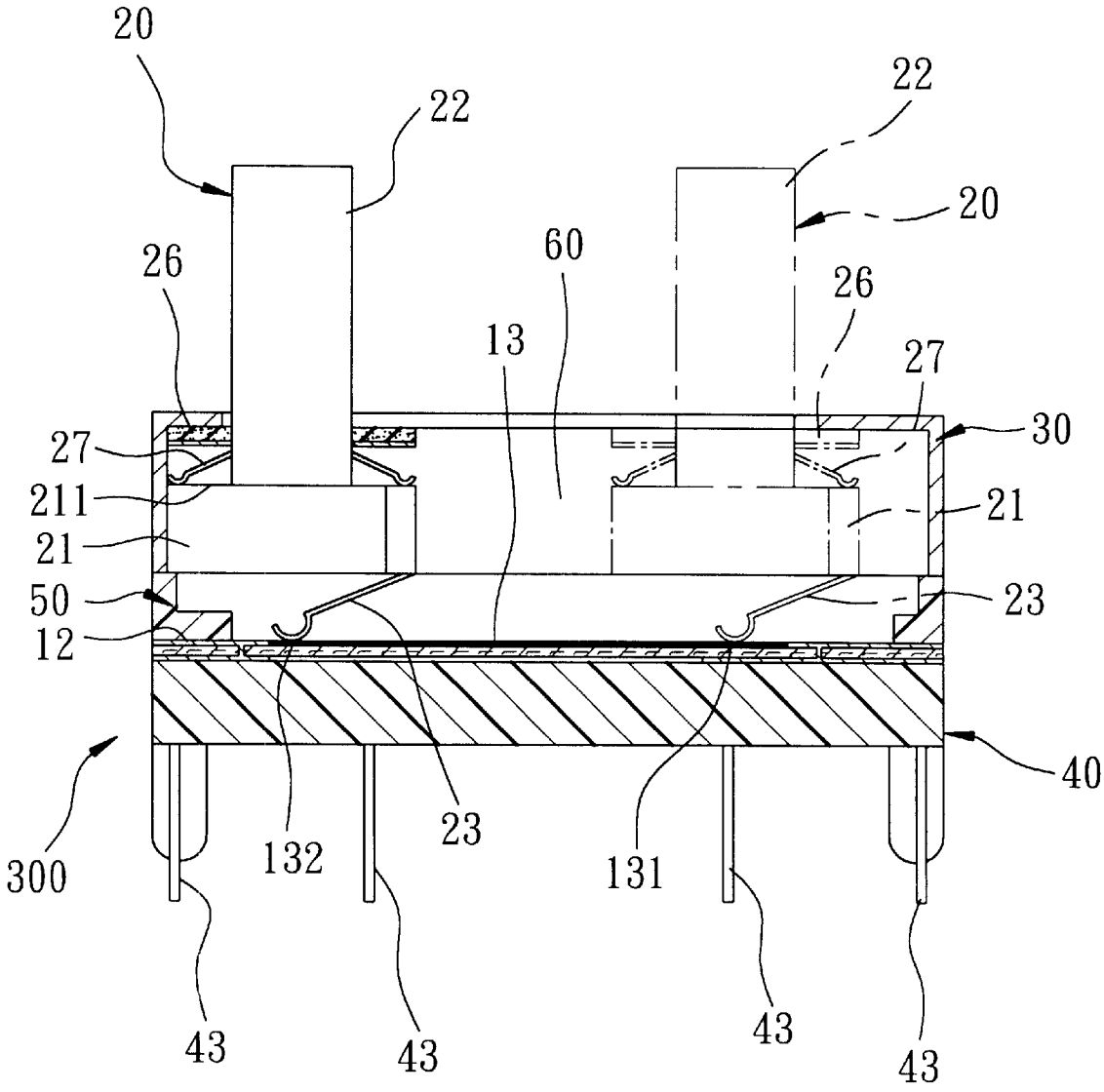
FIG. 7 is a sectional side view of the switch of FIG. 6 to illustrate how a slide member of the switch can be moved between ON and OFF positions.
Figure 8:
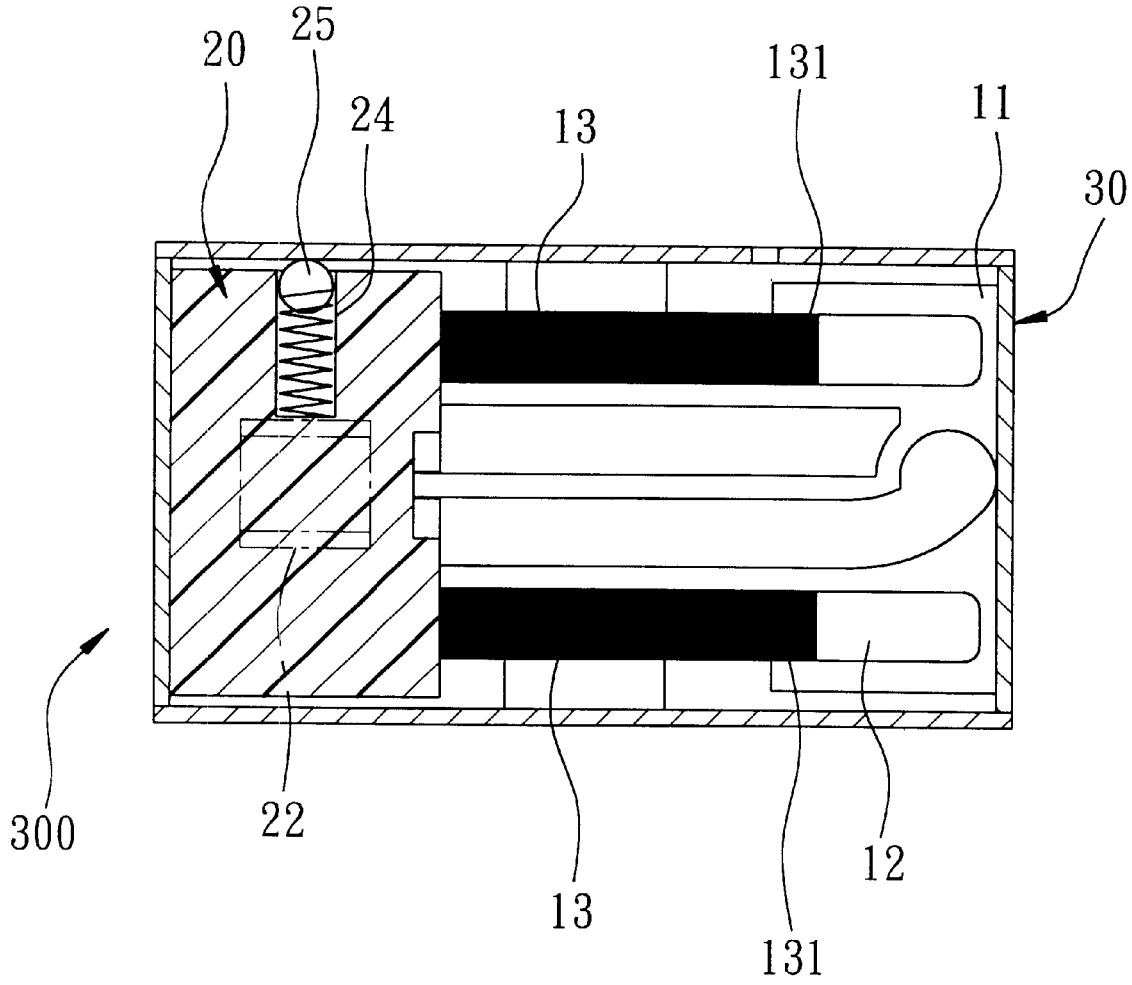
FIG. 8 is a sectional top view to illustrate the slide member of the switch of FIG. 6 at the ON position.

Referring to FIG. 4, in combination with FIG. 6, a cover 410 is disposed over a periphery of the switch hole 420, and is formed with an outer slot 421 that is vertically aligned with the inner slot 33. An operating tab 422 is disposed over the outer slot 421, and is connected to the actuating post 22 so as to move slide member 20 in the longitudinal direction. The periphery of the outer slot 421 has one end 423 that is formed with a soft resilient member 424, such as a rubber, so as to prevent generation of noise upon collision of the operating tab 422 with the end 423 of the periphery of the outer slot 421.

With the variable resistance switch 300, the resistance of the circuit in the microphone is gradually changed upon switching of the slide member 20 to the ON position, thereby eliminating the aforesaid drawbacks as encountered in the prior art.

With the invention thus explained, it is apparent that various modifications and variations can be made without departing from the spirit of the present invention. It is therefore intended that the invention be limited only as recited in the appended claims.

I claim:

1. A microphone with and exterior, comprising:

a housing;

a terminal member disposed in said housing and including a plurality of spaced apart terminals; and a variable resistance switch including at least an elongated resistance member disposed in said housing, extending in a longitudinal direction, and having opposite first and second ends connected to respective ones of said terminals, an elongated conductive member disposed in said housing adjacent and parallel to said resistance member, and having one end connected to a respective one of said terminals, and a slide member including at least a resilient conductive wiper that is disposed in said housing and that is simultaneously and constantly in sliding contact with said resistance member and said conductive member so as to complete a circuit through said terminals, said conductive member, and said resistance member, said slide member being operable to move in said longitudinal direction between an ON position, in which, said wiper is in sliding contact with said second end of said resistance member, and an OFF position, in which, said wiper is in sliding contact with said first end of said resistance member, said wiper being slidable over said conductive member and said resistance member so as to linearly vary the resistance in said circuit when said slide member moves between said ON and OFF positions.

2. The microphone of claim 1, wherein said housing is formed with a switch hole, said switch further including a sheet-type insulator substrate and lower and upper mounting frames which cooperately define a mounting space therebetween, said resistance member and said conductive member being printed on said substrate, said substrate being seated on said lower mounting frame within said mounting space, said switch further including a conductive trace that is printed on said substrate and that extends from said first end of said resistance member in said longitudinal direction, said upper mounting frame having a first side wall formed with a first retaining hole that is aligned with said first end of said resistance member in a transverse direction relative to said longitudinal direction and a second retaining hole that is aligned with said conductive trace in said transverse direction, said slide member further including a wiper mounting seat that is mounted slidably in said mounting space and that has a second side wall confronting said first side wall and formed with a spring retaining recess, said wiper extending downwardly from said wiper mounting seat so as to be slidable over said resistance member and said conductive member, said slide member further including an actuating post that projects outwardly of said mounting space from said wiper mounting seat through said switch hole, and a spring-biased ball mounted in said spring retaining recess and releasably engaging said first retaining hole when said wiper is moved to said first end of said resistance member, said slide member being further movable to a REST position in which said spring-biased ball releasably engages said second retaining hole and said wiper is in sliding contact with said conductive trace and said conductive member so as to permit short circuit of said circuit.

* * * * *